US010731910B2

(12) United States Patent
Lockwood

(10) Patent No.: US 10,731,910 B2
(45) Date of Patent: Aug. 4, 2020

(54) PORTABLE COOLER

(71) Applicant: Brad Lockwood, Brookville, PA (US)

(72) Inventor: Brad Lockwood, Brookville, PA (US)

( * ) Notice: Subject to any disclaimer, the term of this patent is extended or adjusted under 35 U.S.C. 154(b) by 156 days.

(21) Appl. No.: 15/949,610

(22) Filed: Apr. 10, 2018

(65) Prior Publication Data

US 2018/0224181 A1 Aug. 9, 2018

Related U.S. Application Data

(63) Continuation of application No. 14/322,243, filed on Jul. 2, 2014, now Pat. No. 9,939,188.

(Continued)

(51) Int. Cl.

| | |
|---|---|
| ***F25D 11/00*** | (2006.01) |
| *F25D 23/00* | (2006.01) |
| *F25D 23/06* | (2006.01) |
| *A47B 55/00* | (2006.01) |
| *A47B 47/00* | (2006.01) |
| *A47B 55/02* | (2006.01) |
| *A47B 55/06* | (2006.01) |
| *A47B 55/04* | (2006.01) |

(52) U.S. Cl.

CPC ..... *F25D 11/003* (2013.01); *F25D 11/00* (2013.01); *A47B 47/0016* (2013.01); *A47B 47/0091* (2013.01); *A47B 55/00* (2013.01); *A47B 55/02* (2013.01); *A47B 55/04* (2013.01); *A47B 55/06* (2013.01); *F25D 23/003* (2013.01); *F25D 23/062* (2013.01); *F25D 23/063* (2013.01); *F25D 2323/061* (2013.01); *F25D 2400/12* (2013.01); *F25D 2400/16* (2013.01); *F25D 2400/38* (2013.01)

(58) Field of Classification Search

CPC .. F25D 11/003; F25D 11/00; F25D 2323/061; F25D 2400/16; F25D 2400/38; F25D 2400/12; F25D 23/062; F25D 23/003; F25D 23/006; F25D 23/063; A47B 81/064; A47B 55/00; A47B 55/02; A47B 55/04; A47B 55/06; A47B 43/04; A47B 46/00; A47B 47/0016; A47B 47/0091; B60H 1/32; B60H 1/00378; B60H 1/00028; B60H 1/0025; B60H 1/00257; B60H 1/00264

See application file for complete search history.

(56) References Cited

U.S. PATENT DOCUMENTS

| | | | |
|---|---|---|---|
| 2,919,339 | A | 12/1959 | Hilliker |
| 2,962,875 | A | 12/1960 | Barroero |

(Continued)

FOREIGN PATENT DOCUMENTS

| | | | |
|---|---|---|---|
| EP | 2199711 | A2 | 6/2010 |
| JP | H08126558 | A | 5/1996 |

OTHER PUBLICATIONS

Extended European Search Report for European Patent Application No. 14175641.1, dated Feb. 23, 2015, 6 pages.

*Primary Examiner* — David J Teitelbaum

(74) *Attorney, Agent, or Firm* — FisherBroyles, LLP; Craig W. Mueller

(57) ABSTRACT

A portable cooler is provided that includes a base that supports a refrigeration unit. The base also supports a plurality of upwardly-extending support poles that accommodate a top portion. The support poles, top portion, and base define a food storage volume that is surrounded by a plurality of insulative walls.

7 Claims, 13 Drawing Sheets

Related U.S. Application Data

(60) Provisional application No. 61/843,078, filed on Jul. 5, 2013.

(56) References Cited

U.S. PATENT DOCUMENTS

| | | | | |
|---|---|---|---|---|
| 2,980,456 | A | 4/1961 | McMullin | |
| 3,042,384 | A | 7/1962 | Bauman | |
| 3,103,375 | A | 9/1963 | McMullin | |
| 3,284,114 | A | 11/1966 | McCord | |
| 3,291,546 | A | 12/1966 | Traycoff | |
| 3,690,118 | A | 9/1972 | Rainwater | |
| 3,907,147 | A | 9/1975 | Goobeck | |
| 3,976,122 | A | 8/1976 | Neidhardt | |
| 4,006,606 | A | 2/1977 | Underdue | |
| 4,019,339 | A | 4/1977 | Anderson | |
| 4,706,817 | A | 11/1987 | Greathouse | |
| 4,852,741 | A | 8/1989 | Benschoten | |
| 5,181,555 | A | 1/1993 | Chruniak | |
| 5,191,769 | A | 3/1993 | Mangini | |
| 5,367,887 | A | 11/1994 | Byrd | |
| 5,584,188 | A * | 12/1996 | Tippmann | B60H 1/3226 222/146.6 |
| 5,622,276 | A | 4/1997 | Simmons | |
| 5,727,857 | A | 3/1998 | Smith | |
| 5,913,270 | A | 6/1999 | Price | |
| 6,073,547 | A | 6/2000 | Westbrooks | |
| 6,416,101 | B1 | 7/2002 | Bartch | |
| 6,745,588 | B2 | 6/2004 | Kahler | |
| 6,915,657 | B1 | 7/2005 | Wood | |
| 6,973,799 | B2 | 12/2005 | Kuehl | |
| 7,197,888 | B2 | 4/2007 | LeClear | |
| 7,458,591 | B2 | 12/2008 | Vanderberg | |
| 7,481,065 | B2 | 1/2009 | Krieger | |
| 7,536,868 | B1 * | 5/2009 | Ward | A47F 3/0404 62/237 |
| 8,245,524 | B2 | 8/2012 | Kuehl | |
| 2003/0001468 | A1 | 1/2003 | Hase | |
| 2007/0256440 | A1 * | 11/2007 | Trotter | F25D 11/00 62/298 |
| 2008/0271475 | A1 | 11/2008 | Wuesthoff | |
| 2009/0001033 | A1 * | 1/2009 | Sung | A47B 43/04 211/85.3 |
| 2014/0250932 | A1 | 9/2014 | Valdemar | |

* cited by examiner

PORTABLE COOLER

This application is a Continuation of U.S. patent application Ser. No. 14/322,243, filed Jul. 2, 2014, now U.S. Pat. No. 9,939,188 issued Apr. 10, 2018, which claims the benefit of U.S. Patent Application Ser. No. 61/843,078, filed Jul. 5, 2013, the entire disclosures of which are incorporated by reference herein.

FIELD OF THE INVENTION

Embodiments of the present invention are generally related to mobile refrigeration devices and systems that change or maintain the temperature of a storage volume. One embodiment of the present invention is collapsible and easy to store and transport from one location to another.

BACKGROUND

Raw meat and other foodstuffs generally cannot be stored in a warm environment as they will spoil and become a health concern. To address this problem individuals use coolers, ice chests, and sometimes, portable refrigerators or freezers. The cooling systems currently used, however, are not suitable for all applications. More specifically, hunters often skin and clean recently-killed game in the field. In addition, hunting areas are often remote, which makes maintaining ice or getting recently-killed game to a commercial or home cooling system difficult. Transporting common refrigeration devices to remote locations and powering the same is difficult or impossible. One of skill the art will appreciate this problem is exacerbated when hunting during warmer spring, summer, or fall months, when the need to chill the recently-killed game drastically increases. Indeed, remote or temporary refrigeration has been addressed by providing refrigerated trucks that transport and store raw meat. But such vehicles are not cost-effective or feasible as they cannot traverse rugged terrain. In addition, it is inefficient to cool a large volume when a smaller volume is needed, e.g., for a deer.

Some hunters also wish to dry or age recently-killed game, which is difficult or impossible to do at home or in remote locations. That is, many people do not have access to a cooling system large enough to accommodate larger game they can use for an extended period needed to dry or age meat.

It is also desirable to refrigerate food or chill drinks at an event that does not have a refrigeration system. For example, caterers and food truck operators often prepare food off-site that needs to be refrigerated for an extended period of time and require portable refrigeration systems. If the event is at a remote location, ice or other cooling mechanisms must be used, which is costly and cumbersome. Further, some events do not allow large cooling systems due to the noise generated by such systems.

It is thus a long-felt need to provide a portable cooling system that may be used in a variety of locales. The following disclosure describes a portable cooler that is collapsible and easily deployed when needed.

SUMMARY OF THE INVENTION

It is one aspect of embodiments of the present invention to provide a portable cooler that comprises a base or floor that receives and supports a plurality of support poles. The base also accommodates a refrigeration unit. The support poles have a distal end that receive and support a top portion.

The support poles, top portion, and base define a volume for storing game and other foodstuffs. The support poles support walls that may be made of a rigid insulating material, a compliant curtain, a bag, or fabric that maintains the temperature of air within the storage volume. The storage volume receives cold air from the refrigeration unit. The storage volume may be of such size to accommodate an adult, i.e., a walk-in cooler may be provided. Other versions are smaller and are designed to be a reach-in cooler.

Some embodiments of the present invention employ a foldable base member. To enhance portability, the support poles can also be folded or collapsed. The support poles may be telescoping members that facilitate storage and deployment of the portable cooler. Telescoping support poles also allow for the height of the storage volume to be selectively altered. In a collapsed or expanding configuration, the portable cooler is easy to transport and, in some embodiments, towed behind a vehicle.

In operation, a base extension is rotated away from a main base portion that accommodates the refrigeration unit to increase the size of the base area. The base and base extension includes a plurality of receivers that accept one or more support poles that extend upwardly from the base. The top portion is interconnected to the distal ends of each support pole. Finally, walls or a bag is associated with the support poles to create a storage volume.

To collapse the portable cooler, these steps are reversed. More specifically, the top portion is removed from the support poles, the support poles are removed from the base, and the base extension is folded such that a top surface is placed adjacent to a top surface of the base. The top portion is then interconnected to the refrigeration unit and to the underside of the base extension. The collapsed unit may be moved, towed, or otherwise transported. The base may have wheels similar to traditional vehicle tires and a trailer hitch. The base may alternatively have a plurality of castor wheels. In other embodiments, the base can selectively interconnect to a truck bed, wherein the base extension may correspond to a truck's tailgate.

It is another aspect of embodiments of the present invention to provide a portable cooler that can be selectively scaled to accommodate a user's needs. Because it may be desirable, and more efficient, to cool a small volume, collapsible, sectional, or telescoping support poles may be employed such that the height of the food storage volume can be selectively increased or decreased. In other situations, the top portion is spaced a greater distance from the base so larger game may be hung from cross pieces associated with the top member. This configuration dictates that the support poles are extended to their maximum height.

It is another aspect of the present invention to provide a portable cooler that can be integrated with or communicate with an existing cooling system. That is, some of the contemplated portable coolers do not need or do not employ a refrigeration unit wherein cold air is supplied by another cooling system, such as a refrigeration truck or a residential/commercial air-conditioning system. This system is designed to augment existing catering systems. For example, some outdoor events accommodate beer trucks with integrated cooling systems, and the portable cooler may draw cold air from the beer trucks' cooling system. The storage volume can also treat individuals affected by heatstroke and placed at various locations of an outdoor concert, for example, where cold air is directed to the volume from a beer truck or other source.

It is another aspect of embodiments of the present invention to provide a portable cooler that helps prevent spoilage by reducing the temperature of a storage volume to reduce the progression of microbes and bacteria. This aspect is desirable to hunters that may find it difficult to get their game to a cooler or meat processors timely. Thus, hunters can be confident their game is safe to consume later. Besides providing a cooler environment, the walls of the portable cooler may be coated with or made of a material impregnated with an antimicrobial material. That is, the flexible or static wall elements may be made of a material that resists the growth of bacteria and microbes.

It is yet another aspect of embodiments of the present invention to provide a portable cooler that has rigid walls. More specifically, some applications require thicker, more durable walls. For example, rigid walls may be selectively interconnected to the support poles and top portion. The rigid walls may be foldable such that they can collapse and be transported along with the foldable base. The flexible walls of some embodiments may be opaque to limit the sun exposure to the stored items.

In some embodiments, the refrigeration unit may be set to deliver warm air or a heater or heat pump is employed. Here, the storage volume may be maximized so that an individual can skin and clean an animal in a warm environment which increases comfort. After the carcass is clean, the refrigeration unit is switched to provide cold air. This and other embodiments the present invention may include holes or apertures in the base or base extension to allow fluid, such as blood, to drip onto the ground. One of skill in the art will appreciate that the storage configurations contemplated herein can store other items such as beer kegs, drinks, food, which is beneficial to hunters, caterers, and food truck operators. Further, embodiments of the present invention may be placed in cold environments where the refrigeration unit is used as a heater or heating unit is used in conjunction with the storage volume. In this example, the portable cooler acts as a heated shelter used by ice fishermen, for example.

The contemplated portable cooler, regardless of how used, may be powered by a gas generator, a car battery, camping generator, solar panels, or from a vehicle's engine. This configuration allows hunters to keep warm while their game is hung outside in the cold area.

There is a related aspect of the present invention to provide a storage volume that can be selectively partitioned. The support poles, top portion, or base may include locations the receipt of shelves or partition members. This allows the user to selectively alter the configuration of the portable cooler. Further, some embodiments may permit some zones to be kept colder/warmer than others. It is envisioned that the refrigeration unit may be the direct air at different temperatures to multiple zones to ensure that food or drinks are the desired or proper temperature.

The portable cooler of one embodiment of the present invention uses a common refrigeration unit that comprises a compressor, an evaporator, a pump, etc. Refrigeration unit may be solar powered, gas power, battery powered, or powered by other known means. For example, the refrigeration unit may be selectively interconnected to a power grid. The support poles may be made of PVC or metal. The walls may be impregnated or coated with encapsulated citric acid, lactic Acid, or a combination thereof. The wheels may be caster wheels or, in some embodiments, tires that allow the portable cooler to be transported in a collapsed or deployed state.

It is one aspect of embodiments of the present invention to provide a portable cooler, comprising: a base having a first front edge, first rear edge, and a first lateral edge and a second lateral edge connecting the first front edge and the first rear edge, the base including a first receiver positioned adjacent to the first lateral edge and between the first front edge and the first rear edge, and the base including a second receiver positioned adjacent to the second lateral edge and between the first front edge and the first rear edge; a base extension having a second front edge, second rear edge, and a third lateral edge and a fourth lateral edge, the second rear edge hingedly interconnected to the first front edge, the base extension including a third receiver positioned adjacent to an intersection of the first lateral edge and the second front edge, and the base including a fourth receiver positioned adjacent to an intersection of the fourth lateral edge and the second front edge; a first pole selectively interconnected to the first receiver; a second pole selectively interconnected to the second receiver; a third pole selectively interconnected to the third receiver; a fourth pole selectively interconnected to the fourth receiver; a top frame portion having a fifth receiver that selectively receives a distal end of the first pole, a sixth receiver that selectively receives a distal end of the second pole, a seventh receiver that selectively receives a distal end of the third pole, and an eighth receiver that selectively receives a distal end of the fourth pole; a refrigeration system interconnected to the base adjacent to the first rear edge thereof a top wall associated with the top frame portion; a front wall associated with the top frame portion, the third pole, the fourth pole, and the second front edge; a rear wall associated with the top frame portion, the first pole, the second pole, and the base; a first lateral wall associated with the top frame portion, the first pole, the third pole, the first lateral edge, and the third lateral edge; a second lateral wall associated with the top frame portion, the second pole, the fourth pole, the second lateral edge, and the fourth lateral edge; and wherein the refrigeration system directs air into a volume defined by the top wall, the front wall, the rear wall, the first lateral wall, the second lateral wall, the base, and the base extension.

It is another aspect of embodiments of the present invention to provide a portable walk-in cooler, comprising: a foldable base supported by a plurality of wheels; a cooling element positioned on the foldable base; a plurality of vertical support members selectively interconnected to the foldable base; a top portion interconnected to ends of the vertical support members; selectively deployable wall members spanning between adjacent vertical support members and covering the top portion, wherein the selectively deployable wall members and the foldable base define a selectively accessible enclosed structure with an internal volume; and wherein the temperature of the internal volume is controlled with air provided by the cooling element.

These and other advantages will be apparent from the disclosure of the invention(s) contained herein. The above-described embodiments, objectives, and configurations are neither complete nor exhaustive. As will be appreciated, other embodiments of the invention are possible using, alone or in combination, one or more of the features set forth above or described below. Further, the Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
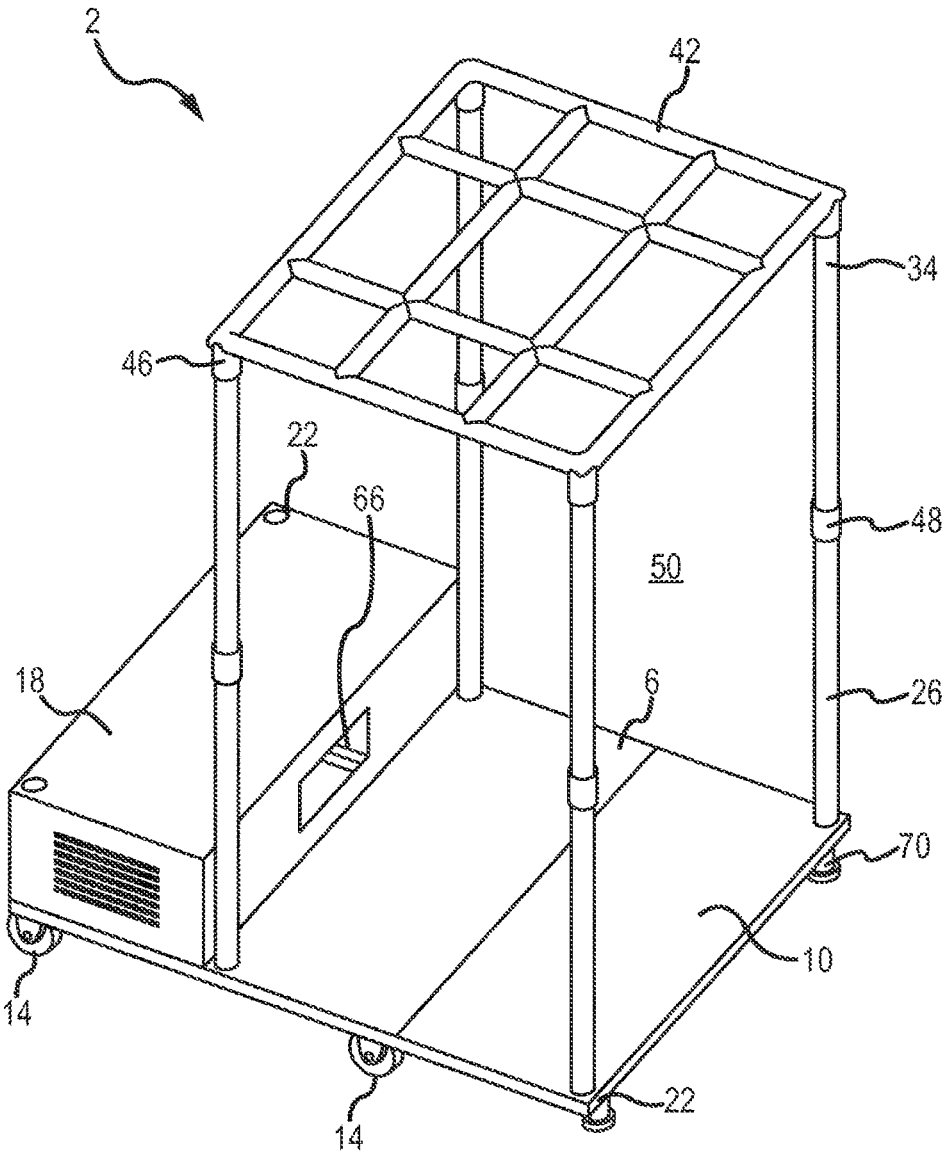
FIG. 1 is a perspective view of the portable cooler system in a first position of use.
Figure 2:
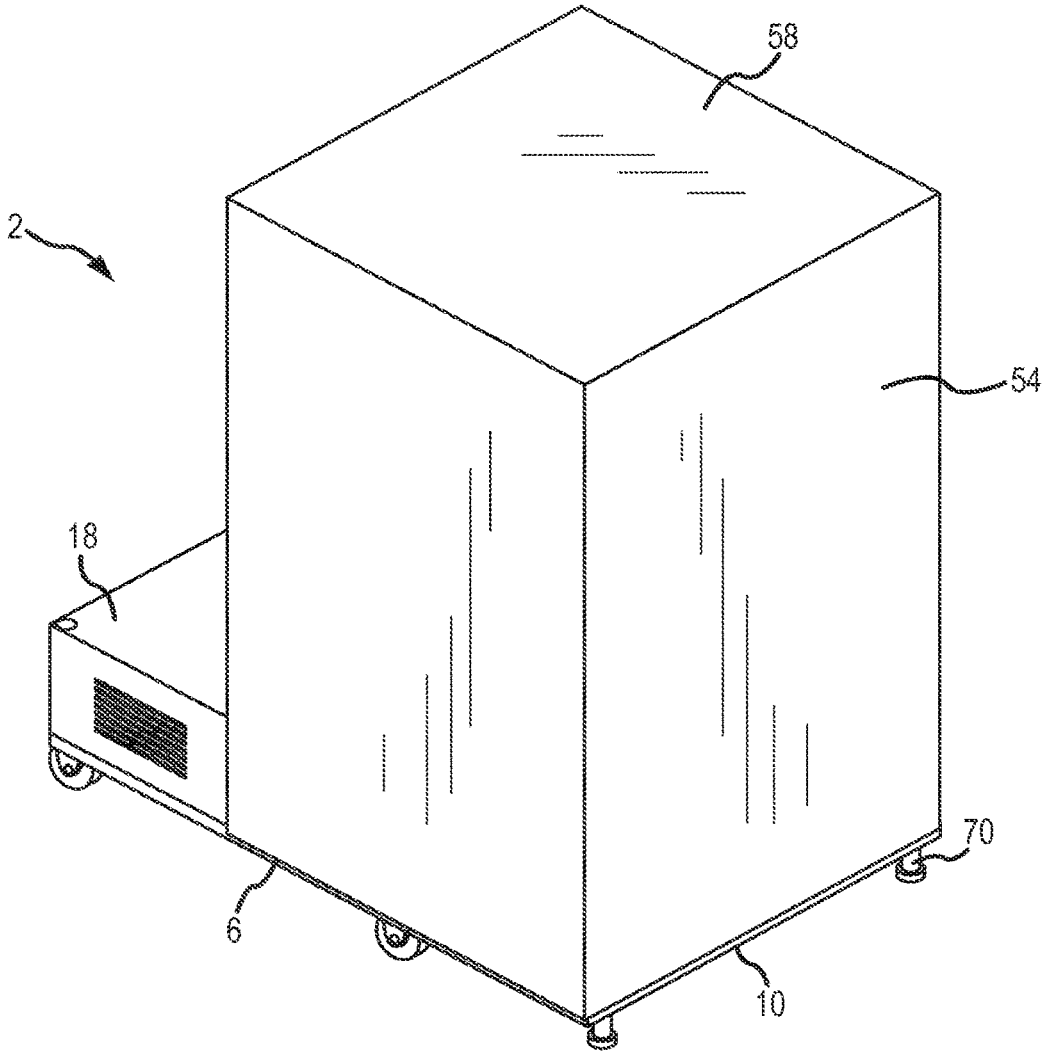
FIG. 2 is a perspective view of the portable cooler system in a first position of use, wherein the selectively deployable wall members are interconnected to support poles.
Figure 3:
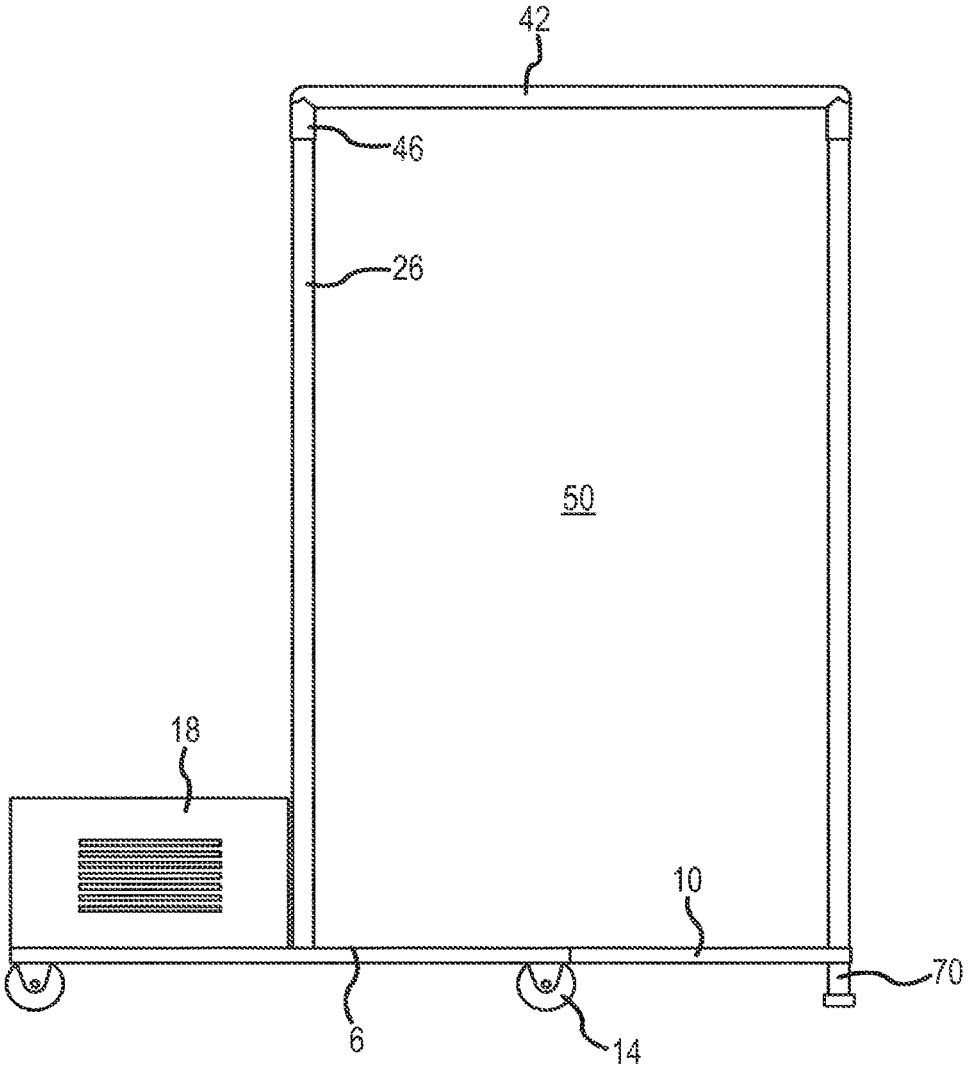
FIG. 3 is a side elevation view of FIG. 1.
Figure 4:
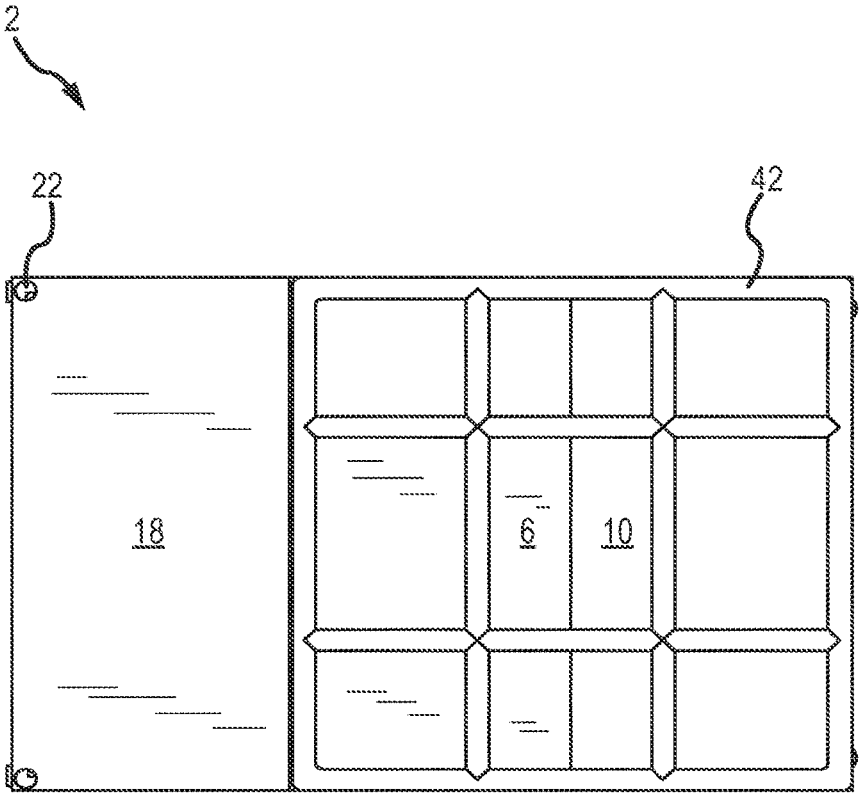
FIG. 4 is a top plan view of FIG. 1.

To assist in the understanding of one embodiment of the present invention the following list of components and associated numbering found in the drawings is provided herein:

| # | Component |
|---|---|
| 2 | Portable cooler |
| 6 | Base |
| 10 | Base extension |
| 14 | Wheel |
| 18 | Refrigeration unit |
| 22 | Receiver |
| 26 | Support pole |
| 34 | Upper end |
| 42 | Top portion |
| 46 | Receivers |
| 48 | Coupler |
| 50 | Storage volume |
| 54 | Side wall |
| 58 | Top wall |
| 66 | Outlet |
| 70 | Foot |

-continued

| # | Component |
|---|---|
| 74 | Bottom surface |
| 78 | Cross member |
| 102 | Portable cooler |
| 106 | Base portion |
| 108 | Internal frame |
| 112 | Scissor lift |
| 116 | Upper member |
| 118 | Refrigeration unit |
| 120 | Horizontal member |
| 124 | Hook |
| 126 | Support poles |
| 128 | Nozzles |
| 130 | Bracket |
| 134 | Shelf |
| 142 | Top portion |
| 150 | Storage volume |
| 202 | Portable cooler |
| 206 | Base portion |
| 218 | Refrigeration unit |
| 222 | Receiver |
| 224 | Hook |
| 226 | Support pole |
| 242 | Top portion |
| 248 | Coupler |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

FIGS. 1-4 show a portable cooler 2 of one embodiment of the present invention that includes a base 6 with a plurality of support poles extending therefrom. A base extension 10 is operatively interconnected to the base 6. In some embodiments, however, the base extension 10 is selectively interconnected and removable from the base 6. In other embodiments, the base is positioned beneath a refrigeration unit 18 and extends, i.e., slides away, from the refrigeration unit. In FIG. 1, the base extension 10 is hingedly interconnected to the base 6 wherein the combination may support about 1000 lbs. The base 6 of one embodiment of the present invention is supported by a plurality of wheels 14. The base 6 supports the refrigeration unit 18, which maybe selectively interconnected to the base 6. The base 6 includes a hole or receiver 22, e.g., a tubular member that receives a support pole 26 that extends from the base 6. The receiver may be selectively interconnected and locked to the base 6 and base extension 10. The support poles 26 may also be locked in an extended configuration. In one embodiment, the distance of from the base 6 to an upper end 34 of the support poles 26 is about 6.5 feet and the base 68 and base extension 10 are about 4 feet by about 4 feet. The upper ends 34 of the support poles 26 support a top portion 42 that includes a plurality of receivers 46 that accept the support poles 26. The top portion 42, support poles 26, and the base 6 (with base extension 10) define a food storage volume 50 that may be about 105 $ft^3$. Sidewalls 54 and a top wall 58 are interconnected to the support poles 26 and the top portion 42, respectively. The sidewalls 54 and top wall may be sewn or otherwise interconnected to form a bag that is fit over the support poles 26 and top portion 42. The side walls 54, top wall 58, and base 6, and base extension 10 are insulated.

The support poles 26 may be extendable and collapsible in a telescoping fashion such that the distance between the top portion 42 and the base 6 and associated base extension 10 may be selectively altered. The support poles 26 may be capable of assuming and maintaining various lengths using known techniques and couplers 48. Examples of telescoping poles are described in U.S. Pat. Nos. 3,284,114, 2,980,456, and 3,103,375. More specifically, it may be desirable or more efficient to decrease the storage volume 50 if small game or other small items are to be stored, as a large storage volume 50 may in some instances be inefficient. FIG. 1 also shows an air outlet 66 of the refrigeration unit 18 that directs cold air into the food storage volume 50. Some embodiments of the present invention employ an air baffle that directs cold air from a position adjacent to the base upwardly towards the top portion 42. The denser cold air drops and moves warmer air at the top of the storage volume closer to the base. The refrigeration unit includes an integrated thermostat that manages temperature within the storage volume.

The refrigeration unit of some embodiments can maintain the temperature of the storage volume 50 to about 36-40° F. If a heat pump is used, the storage volume, or a portion thereof, can be held to about 120° F.

A plurality of feet 70 supports the base extension 10. The feet may be replaced with a member that extends the entirety or portion of the base extension 10 front edge. Another embodiment of the present invention employs additional wheels instead of feet. In some embodiments, no feet are required wherein the support poles extend through the base extension and contact the ground.

Figure 5:
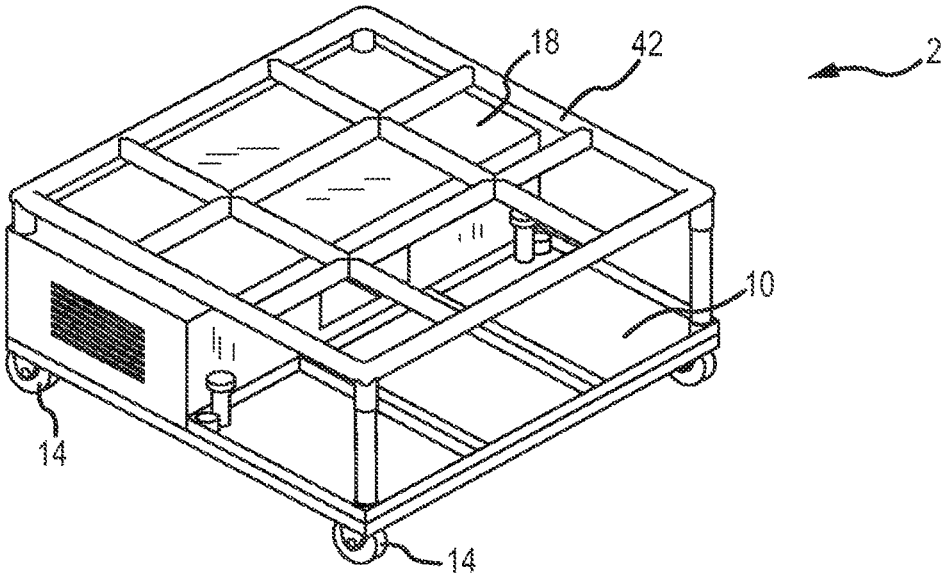
FIG. 5 is a perspective view of the portable cooler system in a second, collapsed position of use.
Figure 6:
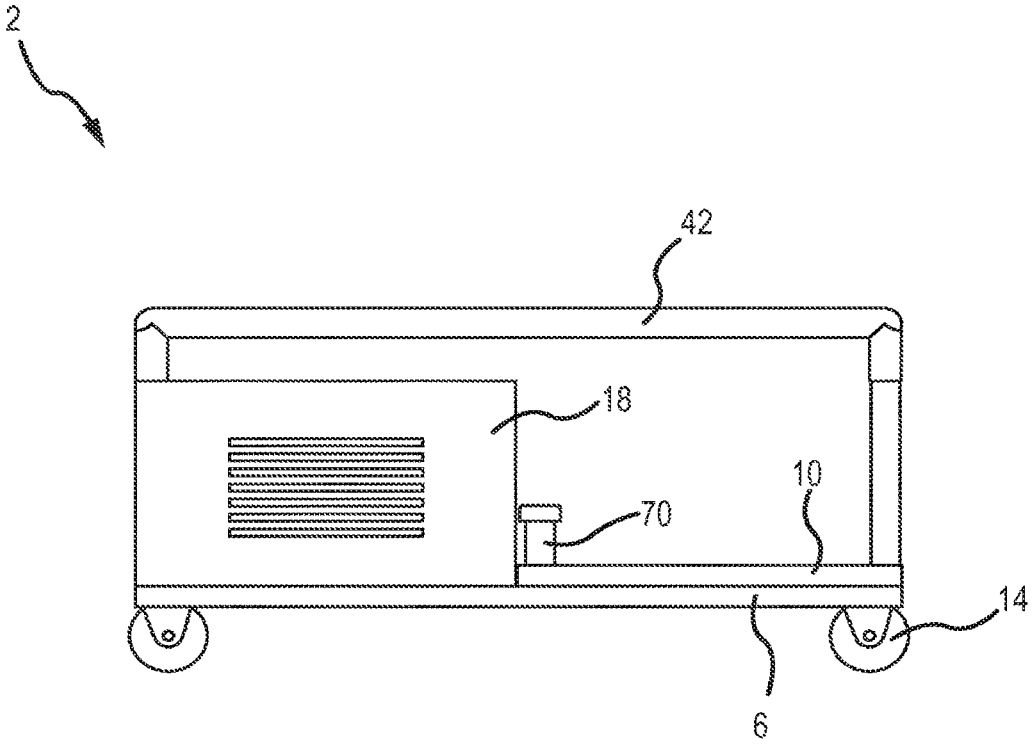
FIG. 6 is a side elevation view of FIG. 5.

FIGS. 5 and 6 show the portable cooler 2 collapsed. The portable cooler 2 of one embodiment may assume a decreased outer envelope of about 4'×4'×10". To collapse the portable cooler, the support poles are telescopingly reduced in length and the top portion 42 is removed. The support poles are removed from receivers 22 associated with the refrigeration unit 18 and the base extension 10. Next, the base extension 10 is rotated over the base 6. Two support poles 26 are collapsed and placed in receivers in the underside of the base extension 10. The top portion 42 is then interconnected to the refrigeration unit 18 and to the collapsed support poles interconnected to the underside of the base extension. One of ordinary skill in the art will appreciate that the top portion 42 may be supported in this configuration by smaller support members that are different from the support poles used to maintain the position of the top portion when the portable cooler is erected. Alternatively, the support poles 26 may be severable and a portion of the full-length support poles are used to support the top portion has shown. Two of the receivers 46 of the top portion 42 are placed in the receivers 22 associated with the refrigeration unit 18. Although the collapsed portable cooler is configured for transport, food or other items can be stored resting on the bottom surface 74 of the base extension 10. In this example, smaller walls are employed to cover the top portion 42, front and lateral sides of the portable cooler 2. This reduced volume may be sufficient to chill game and other smaller items. One embodiment of the present invention, which includes a folded insulative bag, weighs about 300 lbs. Further, the portable cooler 2 may be set up or collapsed in about 10 minutes or less.

The top portion 42 of some embodiments of the present invention employ a plurality of cross members 78 that provide additional support to structure. The cross member 78 may also be used to hang food or game. In some embodiments, the cross members 78 may be selectively interconnected and which allows the top portion 42 to be altered in size and shape to fit the user's needs.

Figure 7:
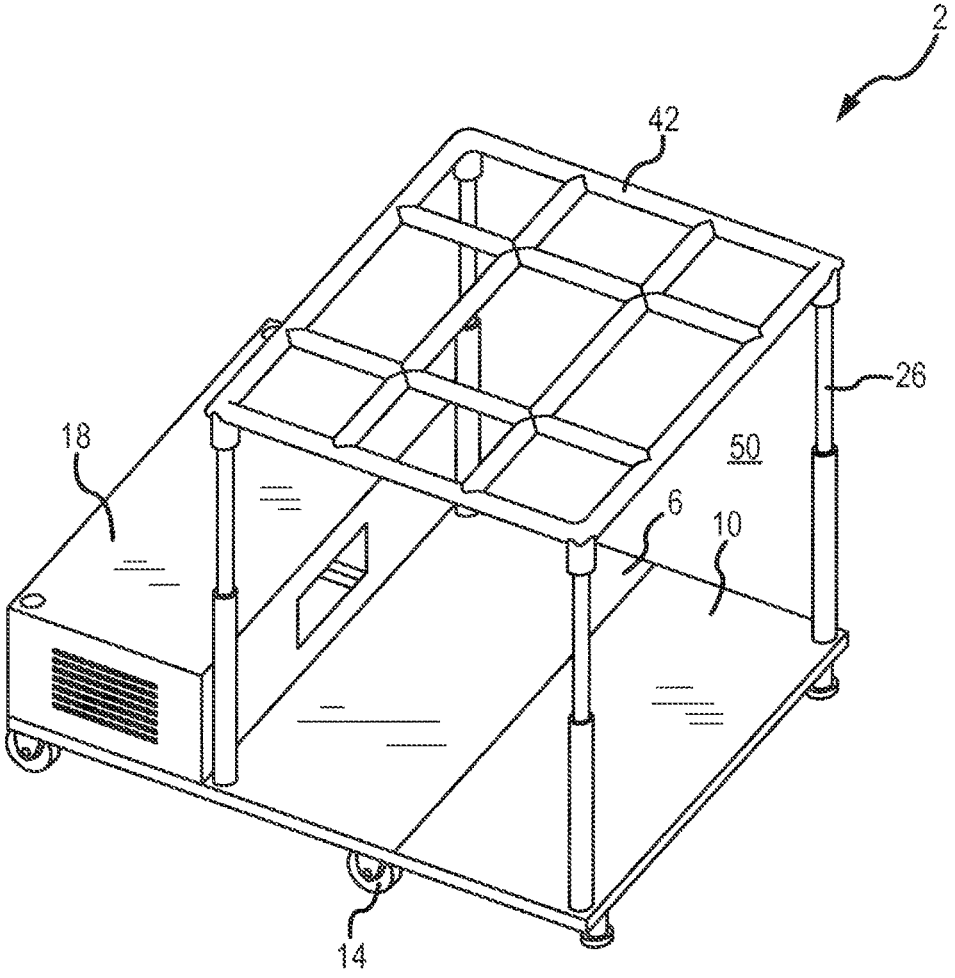
FIG. 7 is a perspective view similar to that of FIG. 1, wherein support poles are partially collapsed and walls that define storage volume are removed for clarity.
Figure 8:
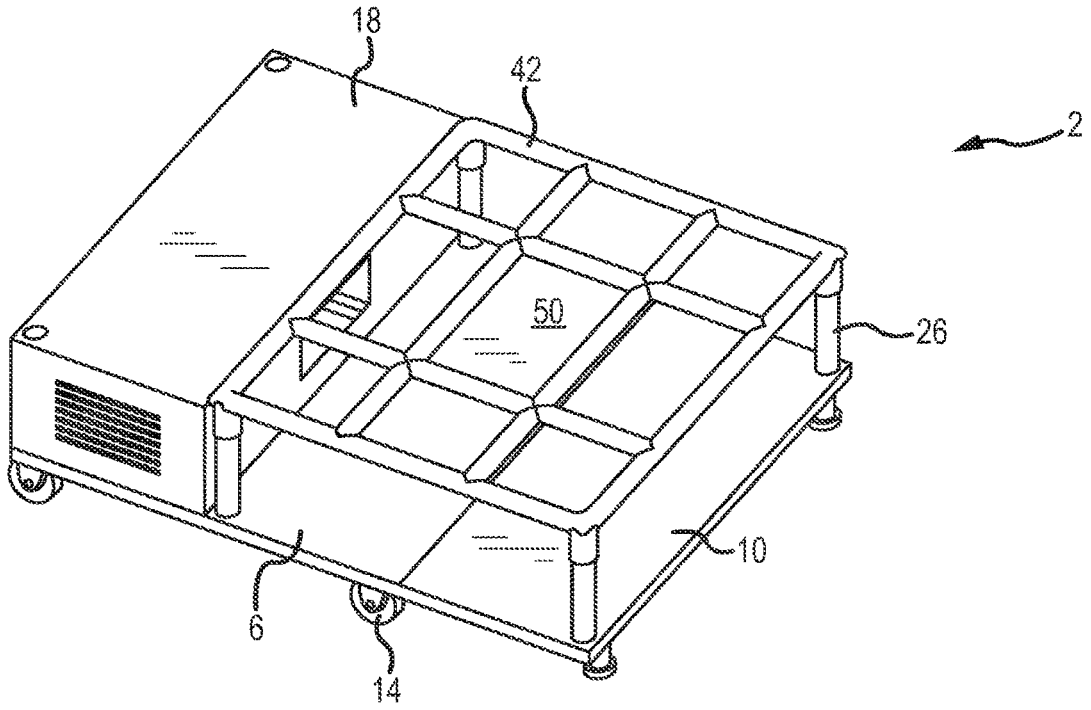
FIG. 8 is a perspective view similar to that of FIG. 7 wherein a top portion of the portal cooler is positioned adjacent to a base portion and the walls are removed for clarity.
Figure 9:
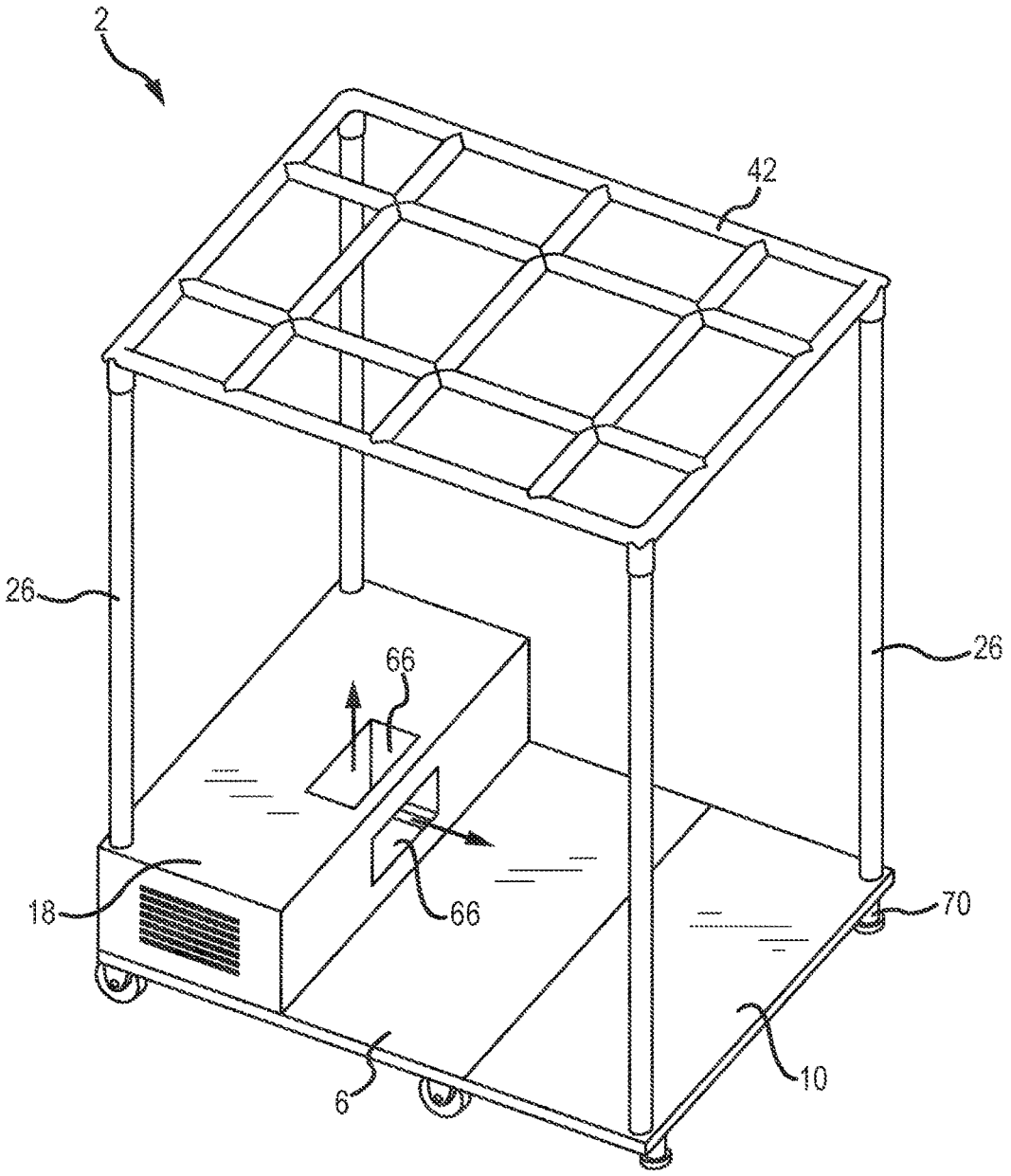
FIG. 9 is a perspective view of the portable cooler with an extended top portion and fully extended support poles, wherein the walls have been removed for clarity.

FIGS. 7-9 illustrate how embodiments the present invention may be used to customize the storage volume size. As some embodiments of the present invention employ telescoping or sectional support poles 26, the top portion 42 may be moved closer to the base 6 if desired. The support poles may be fixed at a shorter length. FIG. 8 shows an example wherein the support poles 26 are retracted to a minimum height to drastically reduce the storage volume. In this configuration the walls would need to accommodate the shorter support poll length. Thus, to suit this functionality, flexible, foldable, or severable walls may be required. That is, the insulative walls or bags of some embodiments have portions that are removable so that the size, shape, or height of the walls may be customized.

In operation, the base of a collapsed portable cooler is expanded by rotating the base extension 10 away from the base 6. The support poles 26 are then interconnected to the base extension 10 and the refrigeration unit 18. The top portion 42 is then interconnected to the ends 34 of the vertical support poles 26. Walls 54, 58, which may comprise a flexible and compliant bag, are placed over the top portion 42 and the associated support poles 26. One of skill in the art will appreciate that the walls may be comprised of separate wall panels that interconnect to the top portion 42 and associated support poles 26. At least one of the wall members may have an opening, door, or curtain that provides access to the storage volume 50. The user steps onto the base, under the top portion, and stands which moves the top portion away from the base and extends the support poles 26. The support poles 26 are locked at their extended length. Movement of the top portion 42 away from the base 6 also expands the walls so that they accommodate the entire storage volume 50. The refrigeration unit 18 is powered by traditional 120-224V power source. Some embodiments use a refrigeration unit 18 that is powered by a 115V, 10 A power source. Alternatively, the refrigeration unit 18 is solar powered, battery powered, gas powered, powered by way of an interconnected or integral generator, or powered with electricity obtained from a vehicle.

FIG. 9 shows another configuration that maximizes storage volume 50. Here, the top portion 42 has been altered, i.e., expanded, as alluded to above. The rearmost support tubes 26 are interconnected to receivers 22 at the corners of the refrigeration unit 18, which increases the amount of food storage capacity. One of skill in the art will appreciate that the food storage volume 50 may be partitioned with rigid or semirigid shelves or walls that are hung, attached, or supported to the support poles 26, top portion 42, the top of the refrigeration unit 18, base 6, or base extension 10. In this example, the refrigeration unit 18 may have a plurality of outlets 66 that direct air of different temperatures to different areas of a partitioned storage volume 50. For example, in some instances drinks may be stored in a compartment above the refrigeration unit 18 and food stored or game hung in the main compartment, wherein the user may selectively tailor the temperature of the individual compartments. This aspect of the present invention is desirable for caterers or vendors who commonly offer various types of foods and beverages that need to be maintained at different temperatures.

Figure 10:
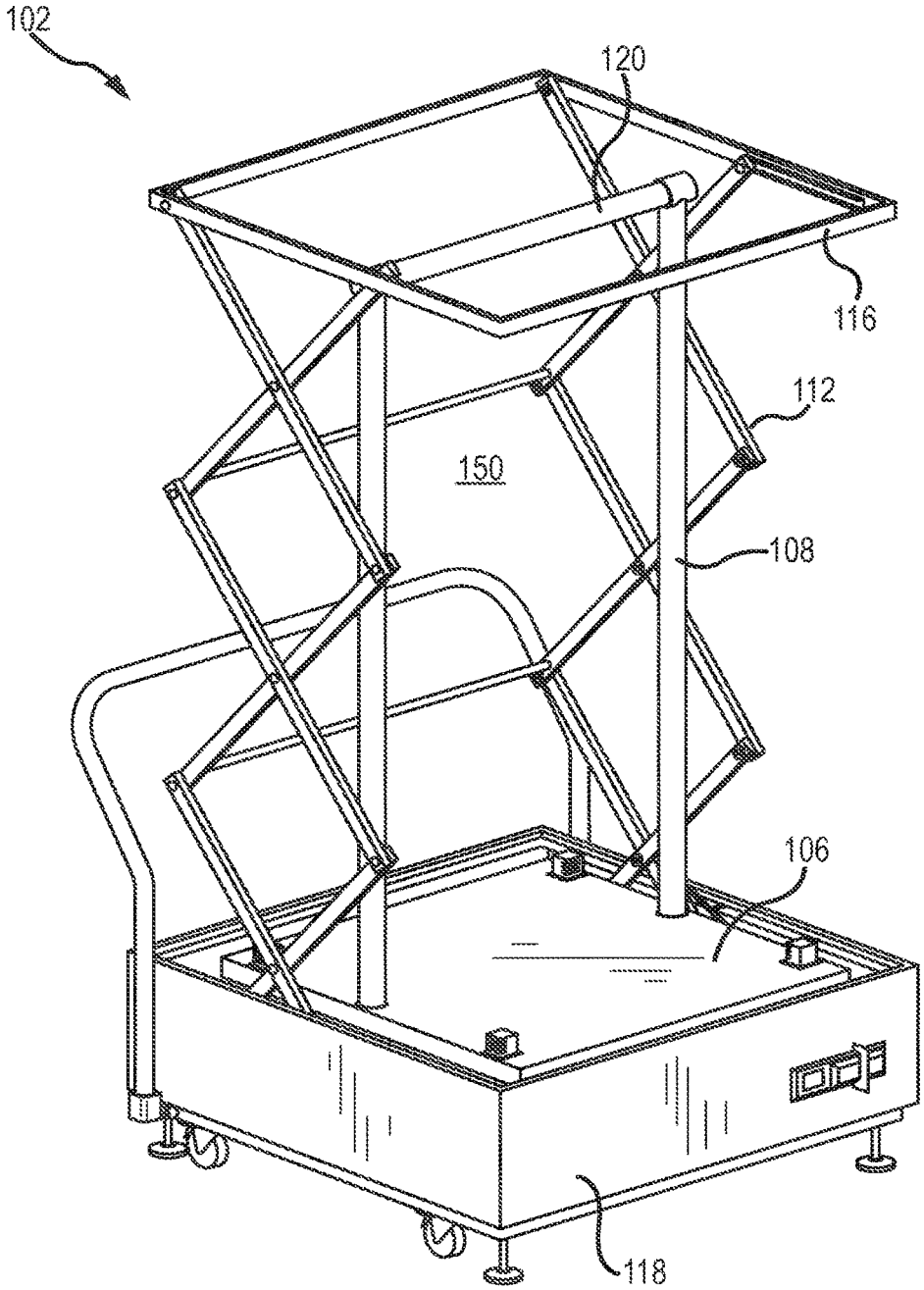
FIG. 10 is a perspective view of alternative embodiment of the present invention that employs a scissor lift system to extend the top portion from the base.
Figure 11:
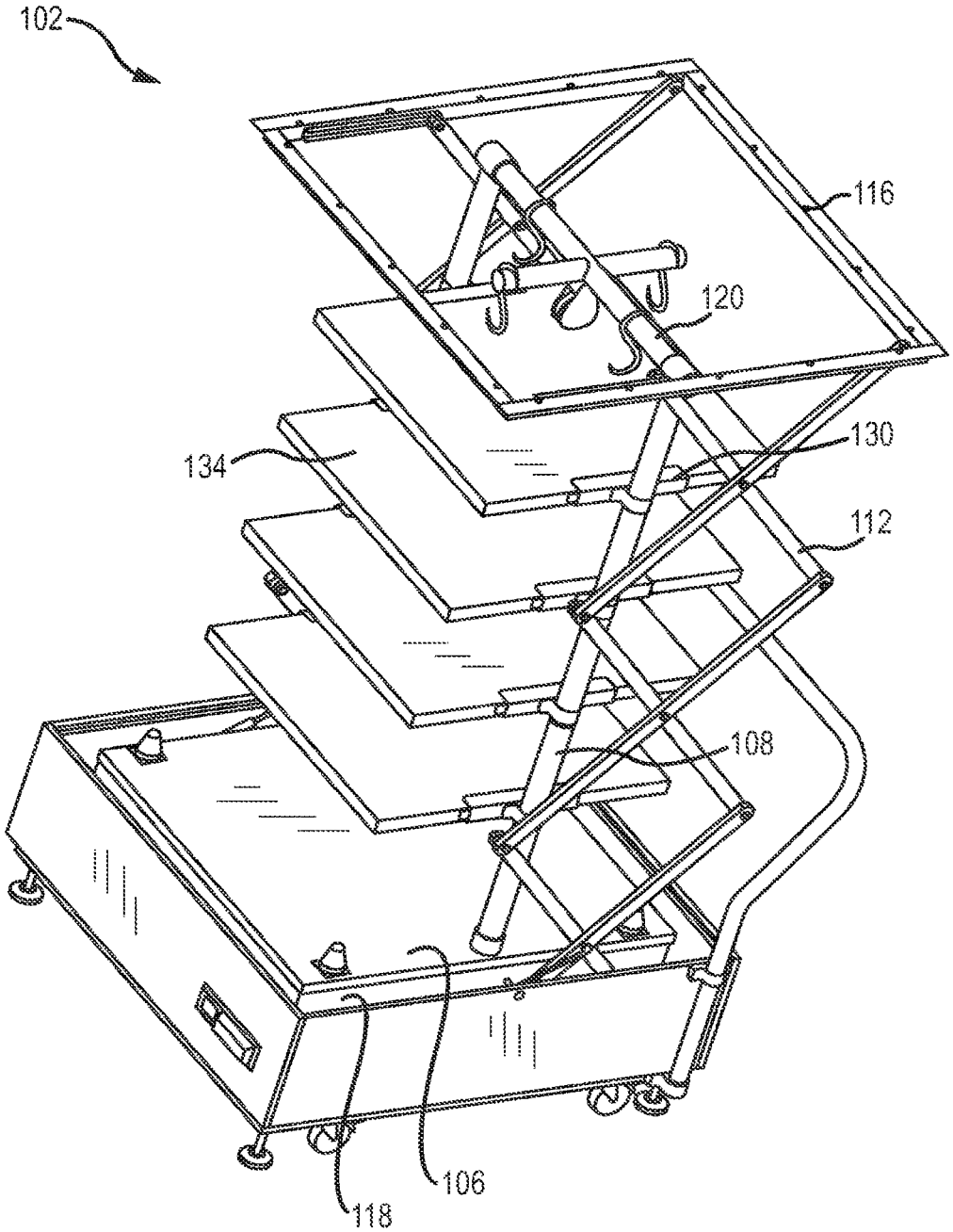
FIG. 11 is a perspective view of an embodiment similar to that of FIG. 10 that includes a plurality of shelves.

FIGS. 10 and 11 show a portable cooler 102 of another embodiment of the present invention that does not include a base extension. This smaller envelope version employs a generally square base portion 106 that supports an internal frame 108 for hanging game, for example. A scissor lift system 112 that terminates at an upper member 116. In operation, an insulative bag (not shown) is placed over the upper member 116 and the scissor lift system 112 is used to increase the distance between the upper member 116 and the base portion 106 to create a storage volume 150. The internal frame 108 also includes a horizontal member 120 that receives one or more hooks 124 to support game in a cold environment provided by a refrigeration unit 118. Here, the refrigeration unit 118 is built into the base portion 106 wherein cold air is directed through a plurality of nozzles 128 into the storage volume and. FIG. 11 shows that the internal support structure may accommodate a plurality of brackets 130 for securing a plurality of shelves 134, which partitions the storage volume 150.

Figure 12:
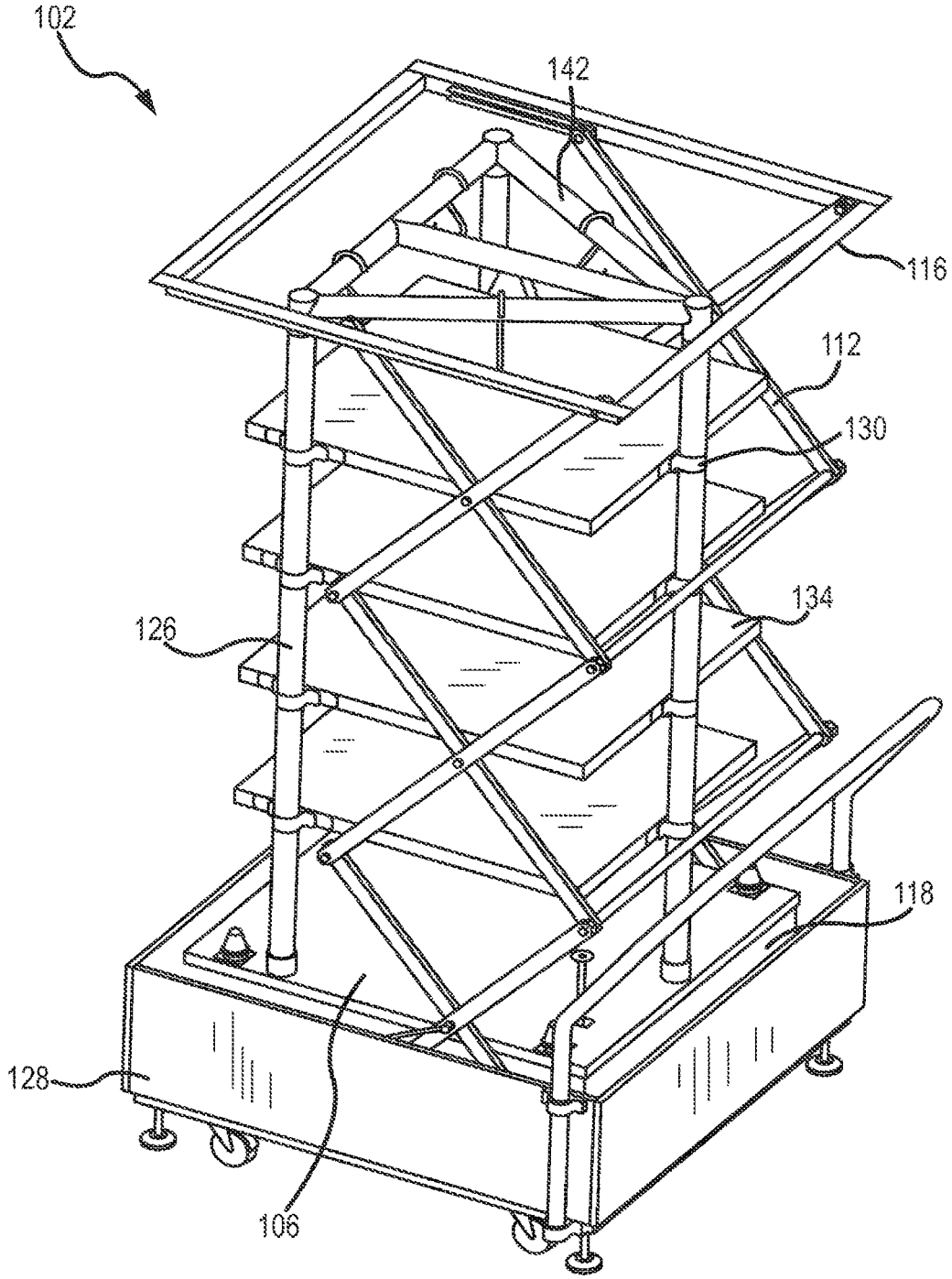
FIG. 12 is a perspective view of an embodiment similar to that of FIG. 11 that also includes a triangular upper support member.
Figure 13:
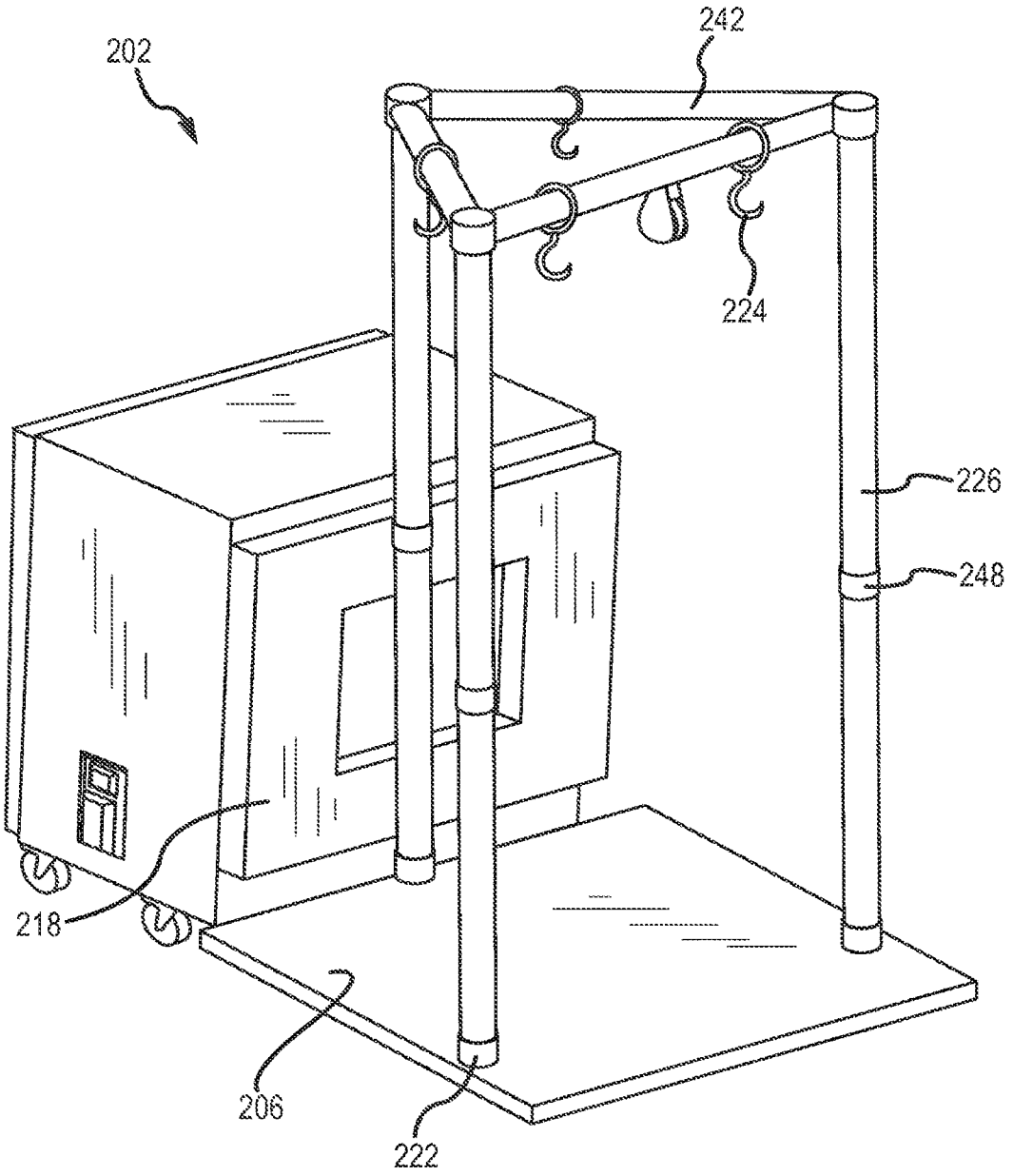
FIG. 13 is a perspective view of another embodiment of the present invention that in employs a base that is foldable from an upright refrigeration unit.

FIG. 12 is similar to the embodiments the present invention shown in FIGS. 10 and 11. Here, the internal frame includes three support poles 126 and an interconnected triangular top portion 142. One of skill the art will appreciate that shelves 134 may be included may be supported by all three support poles 126. This embodiment also employs an upper frame 116 that is interconnected to a scissor lift system 112 that moves the top member away from the base element to create a storage volume 150.

FIG. 14 shows a portable cooler 202 of another embodiment of the present invention wherein a base portion 206 is folded or slid from a refrigeration unit 218. The base portion 206 is rectangular or square and includes a plurality of receivers 222 that accept collapsible support poles 226. Cold air from the refrigeration unit 218, which is shown upright in this embodiment, is directed through nozzles or through an opening as described above into the storage volume 250. Although a three polled, triangular system is shown, one of skill in the art will appreciate a four pole configuration as described above without departing from the scope of the invention.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A portable cooler, comprising:

a base having a front edge, rear edge, and a first lateral edge, and a second lateral edge connecting the front edge and the rear edge, the base including:

a selectively movable base extension interconnected to the front edge;

a first receiver corresponding with the first lateral edge and a front edge of the base extension, a second receiver corresponding with the second lateral edge and the front edge of the base extension, a third receiver corresponding with the first lateral edge and located between the first receiver and the rear edge, and a fourth receiver corresponding with the second lateral edge and located between the second receiver and the rear edge;

a first pole selectively interconnected to the first receiver;

a second pole selectively interconnected to the second receiver;

a third pole selectively interconnected to the third receiver;

a fourth pole selectively interconnected to the fourth receiver;

a top frame portion having a fifth receiver that selectively receives a distal end of the first pole, a sixth receiver that selectively receives a distal end of the second pole, a seventh receiver that selectively receives a distal end of the third pole, and an eighth receiver that selectively receives a distal end of the fourth pole;

a refrigeration system interconnected to the base adjacent to the rear edge thereof;

a top wall associated with the top frame portion;

a front wall associated with the top frame portion, the first pole, and the second pole;

a rear wall associated with the top frame portion, the third pole, and the fourth pole;

a first lateral wall associated with the top frame portion, the first pole, and the third pole; and a second lateral wall associated with the top frame portion, the second pole, and the fourth pole.

2. The portable cooler of claim 1, wherein the first pole, the second pole, the third pole, and the fourth pole are collapsible.

3. The portable cooler of claim 1, wherein the top frame includes a plurality of cross members.

4. The portable cooler of claim 1, wherein the front wall, the first lateral wall, and the second lateral wall are selectively interconnected.

5. The portable cooler of claim 1, further comprising a first wheel interconnected to the base at an intersection of the rear edge and the first lateral edge, a second wheel interconnected to the base at an intersection of the rear edge and the second lateral edge, a third wheel interconnected to the base at an intersection of the front edge and the first lateral edge, and a fourth wheel interconnected to the base at an intersection of the front edge and the second lateral edge.

6. The portable cooler of claim 5, wherein the wheels are castor wheels.

7. The portable cooler of claim 5, wherein the wheels are tires.

* * * * *